US006116173A

United States Patent [19]

Beyer

[11] Patent Number: 6,116,173

[45] Date of Patent: Sep. 12, 2000

[54] MODULE AND BAR FOR TUFTING TOOLS

[76] Inventor: Walter Beyer, Patternhof 30, D-52249 Eschweiler, Germany

[21] Appl. No.: 09/091,801

[22] PCT Filed: Dec. 11, 1996

[86] PCT No.: PCT/DE96/02468

§ 371 Date: May 7, 1999

§ 102(e) Date: May 7, 1999

[87] PCT Pub. No.: WO97/23679

PCT Pub. Date: Jul. 3, 1997

[30] Foreign Application Priority Data

Dec. 12, 1995 [DE] Germany ..... 295 20 281

[51] Int. Cl.[7] ..... D05C 11/04; D05C 15/10

[52] U.S. Cl. ..... 112/80.45; 112/80.6

[58] Field of Search ..... 112/80.45, 80.01, 112/80.4, 80.6

[56] References Cited

U.S. PATENT DOCUMENTS

| | | | |
|---|---|---|---|
| 5,295,450 | 3/1994 | Neely | 112/80.45 |
| 5,400,727 | 3/1995 | Neely | 112/80.45 |
| 5,927,219 | 7/1999 | Beyer | 112/80.45 |
| 5,954,003 | 9/1999 | Beyer et al. | 112/80.45 |

*Primary Examiner*—Peter Nerbun
*Attorney, Agent, or Firm*—John C. Purdue; David C. Purdue

[57] ABSTRACT

A needle module and needle bar is disclosed in which tufting tools are cast at one end into a plate-shaped module basic body having a plane face bearing on a plane bearing face of the bar and at least one perforation, through which a fastening screw can engage and be screwed into the bar, wherein the module is secured positively to the bar in the vertical direction by means of a first groove-and-tongue joint and in the horizontal direction by means of a second groove-and-tongue joint and is held non-positively in the direction of the bar by means of the fastening screw.

14 Claims, 4 Drawing Sheets

MODULE AND BAR FOR TUFTING TOOLS

DESCRIPTION

Figure 1:
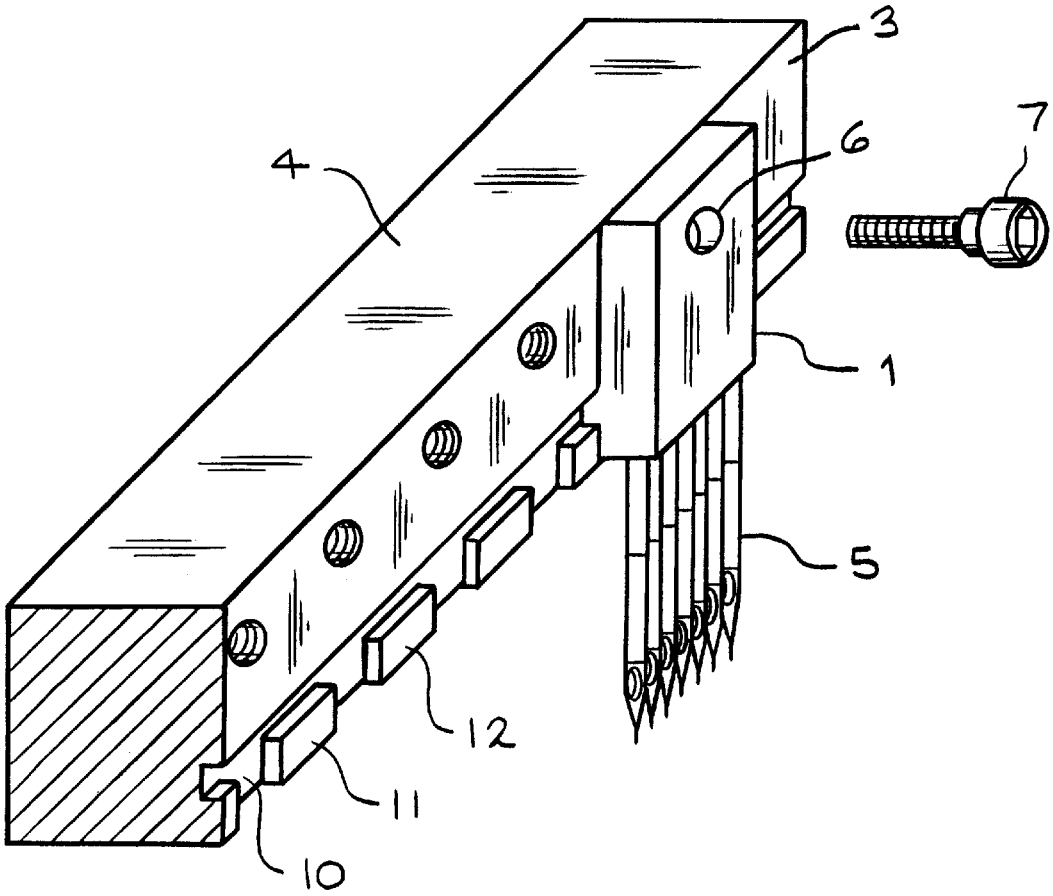

The invention relates to a module and bar for tufting tools, in particular a needle module and needle bar, in which the tufting tools are cast at one end into a plate-shaped module basic body, the length of which corresponds to a multiple of the center distance of the cast-in tufting tools and which has a plane face, bearing on a plane bearing face of the bar, and at least one perforation, through which a fastening screw can engage and be screwed into the bar.

It is known to cast a row of tufting, knitting or Raschel tools, for example needles or grippers, into a module basic body at an exact location and subsequently to fasten the modules, consisting of the tools and the module basic body, to a bar, for example the needle bar of a tufting machine.

For fixing to the bar, the module basic body is provided with a perforation, for example in the form of a bore, through which a screw is led. A corresponding threaded hole is provided in the bar.

DE-A-42 23 642 discloses a bar with module, in which the module additionally has a stop strip and a vertically running guide strip which engages into a matching groove in the needle bar. The guide strip is intended to align and center the module. The fastening bore extends through the guide strip.

Owing to the tolerances of the modules and bar and their bores, the stop strip does not always butt exactly on the bar, so that, under high forces, the module may be slightly displaced vertically.

German Utility Model 295 06 820, then, has already disclosed a bar with modules for tufting tools, in which a longitudinal groove is worked into the bar and each module engages with a projecting moulding into this groove, so that the module is held fixedly in terms of rotation. In addition, the module is to be retained in the vertical and horizontal directions by means of a locating screw or a collar which surrounds the bore of the module annularly and which engages into the bar.

Although, in the installed state, this module is thus seated relatively fixedly in terms of rotation, it has to be secured by means of a special locating screw in order to be installed exactly in position in the longitudinal direction of the bar. If a locating screw of this kind is not used, the module may be displaced, if only slightly, in the longitudinal direction of the bar due to the considerable yarn forces on the tools. The displacement results in an uneven stricture of the fabric produced by means of the tools.

The object on which the invention is based is, by simple means, to design the modules or the bar in such a way that a module is secured reliably in all directions.

The object is achieved, according to the invention, in that the module is secured positively on the bar in the vertical direction by means of a first groove-and-tongue joint and in the horizontal direction by means of a second groove-and-tongue joint and is held non-positively in the direction of the bar by means of the fastening screw.

In a way according to the invention, the arrangement may be designed in such a way that, in order to form to the first groove-and-tongue joint, a continuous horizontal longitudinal groove is provided in each case both in the bar and in the module and a common locating tongue engages into the two longitudinal grooves.

In a way preferred according to the invention, the arrangement may also be designed in such a way that, in order to form the first groove-and-tongue joint, a continuous horizontal longitudinal groove is made in the bar and the module has integrally formed on it a horizontal strip which projects perpendicularly to the plane face of the said module and which engages positively into the longitudinal groove of the bar.

Conversely, according to the invention, the arrangement may also be designed in such a way that, in order to form the first groove-and-tongue joint, a continuous horizontal longitudinal groove is made in the module and the bar has integrally formed on it a horizontal strip which projects perpendicularly to the beating face of the said bar and which engages positively into the longitudinal groove of the module.

In a way according to the invention, the arrangement may also be designed in such a way that the module has two longitudinal grooves separated from one another by a transverse web, and that the transverse web engages positively into a corresponding recess of a locating tongue which is inserted positively into a longitudinal groove of the bar and of which the regions located between the recesses engage positively into the longitudinal grooves of the module.

According to the invention, in order to form the second groove-and-tongue joint, projecting locating pieces may be provided on the bar, the said locating pieces engaging positively in each case into a long hole provided in the module.

According to the invention, in order to form the second groove-and-tongue joint, starting from the horizontal longitudinal groove in the bar, grooves running transversely thereto may also be provided and the module may have integrally formed on it at least one vertical strip which runs perpendicularly to the horizontal strip and which engages positively into such a groove of the bar.

According to the invention, in a converse arrangement, in order to form the second groove-and-tongue joint, starting from the horizontal longitudinal groove in the module, grooves running transversely thereto may be provided and the bar may have integrally formed on it vertical strips which runs perpendicularly to the horizontal strip and which engage positively into such a groove of the modules.

In a way according to the invention, the arrangement may also be designed in such a way that the module has a long hole which run in the vertical direction and the width of which corresponds to the diameter of a locating screw, by means of which the module is fastened to the bar.

Both in this embodiment and in the embodiment having a locating piece as a second groove-and-tongue joint, the long hole may be open towards the upper edge of the module.

In a way preferred according to the invention, the grooves may be cut by milling.

In a way preferred according to the invention, the module may have, on the side opposite the plane face, a second plane face on which corresponding strips are integrally formed. The module can then also be used in an arrangement rotated through 180°.

If integrally formed strips are provided, these are preferably to be worked as a fit.

The strips may be integrally formed on the module by the injection-moulding method The advantage of the invention is that the module is secured fixedly in terms of displacement and rotation in all directions as early as when it is inserted. A normal screw connection may be used for retention on the bar.

Figure 2:
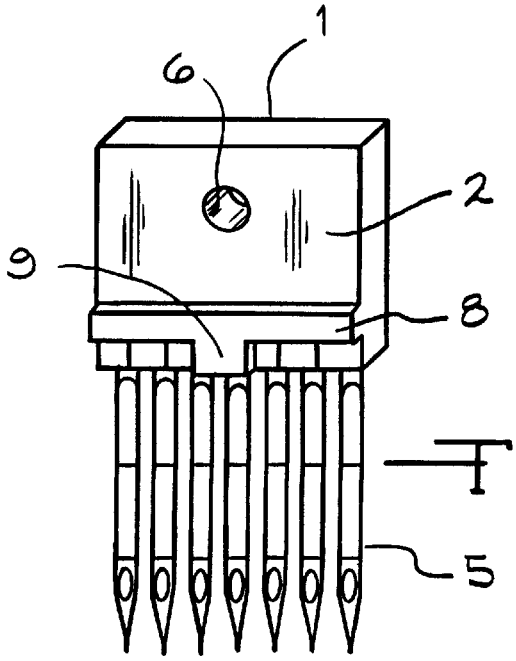
Figure 3:
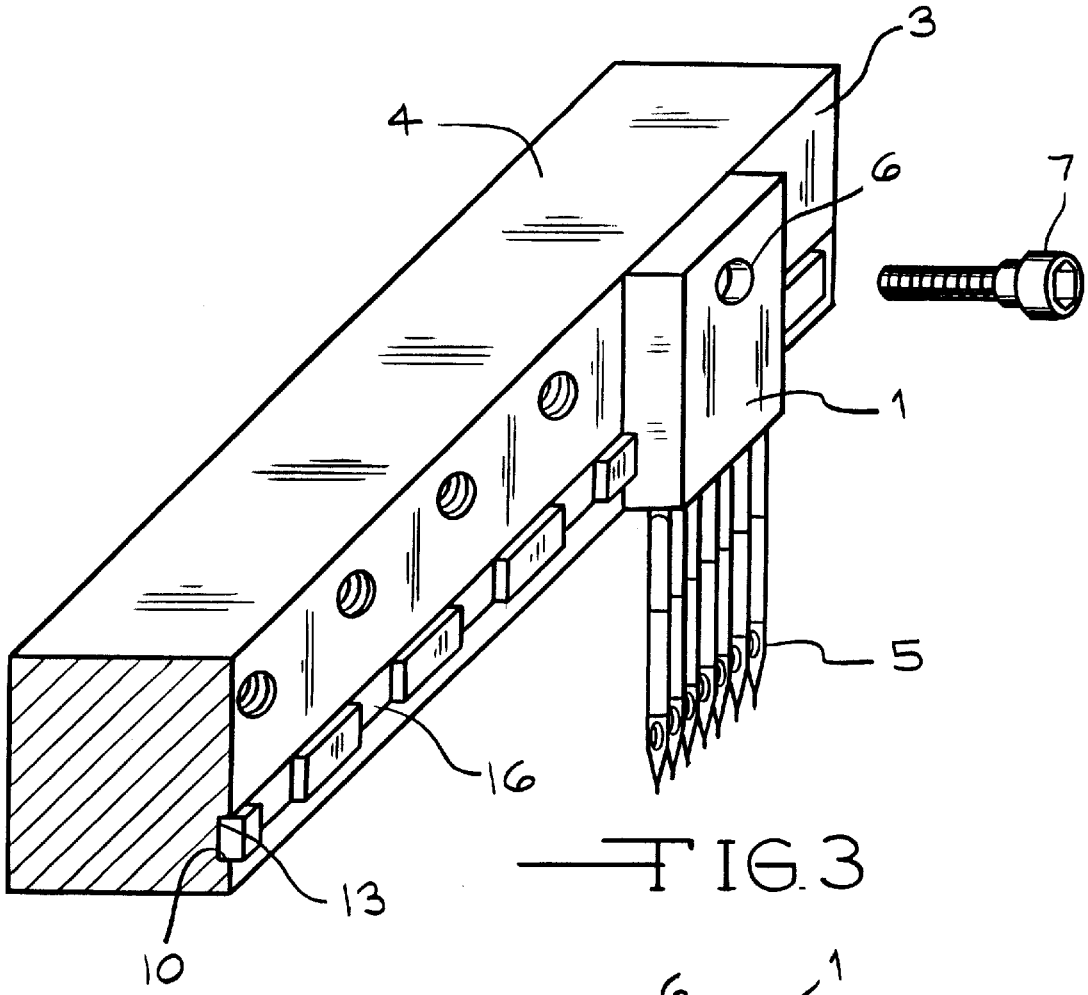
Figure 4:
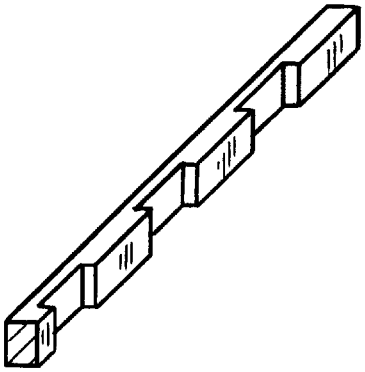
Figure 5:
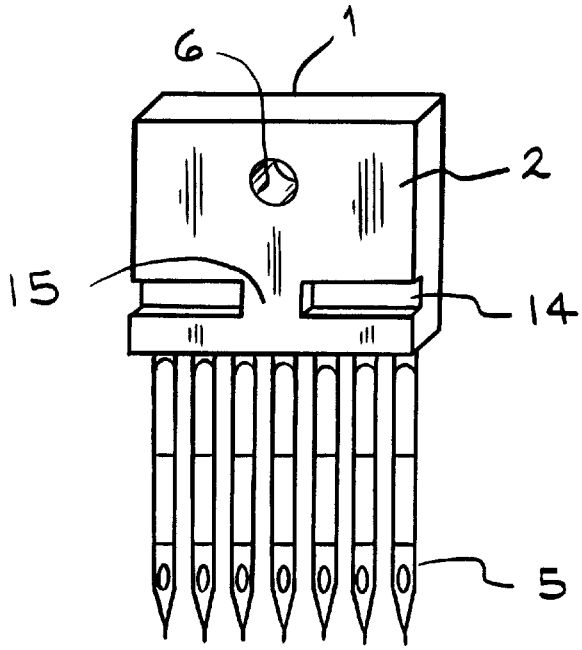
Figure 6:
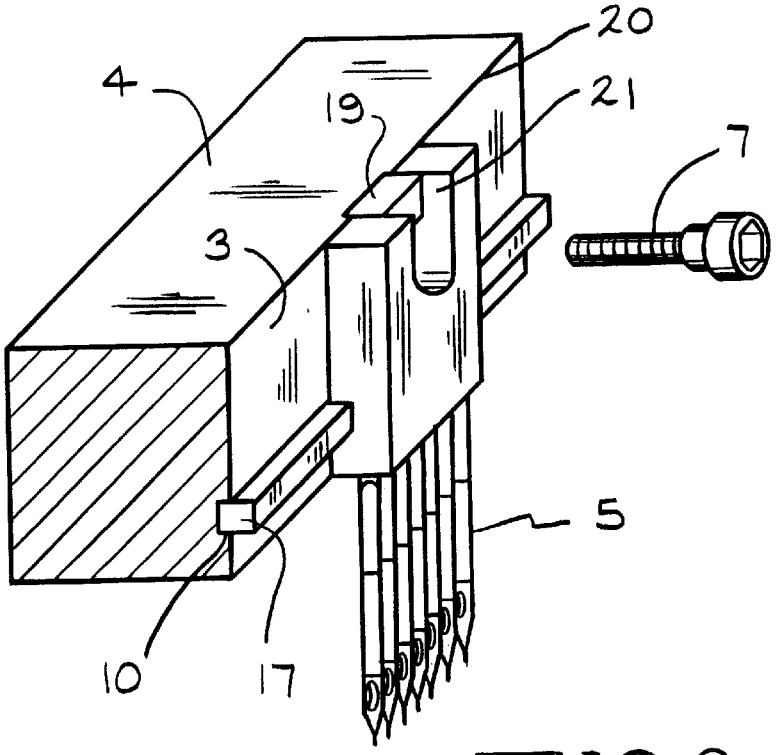
Figure 7:
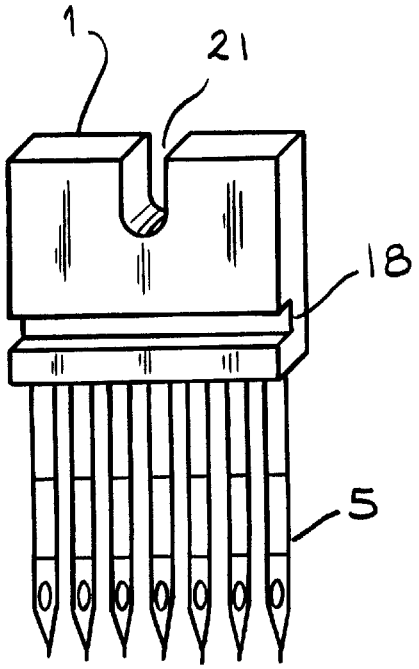
Figure 8:
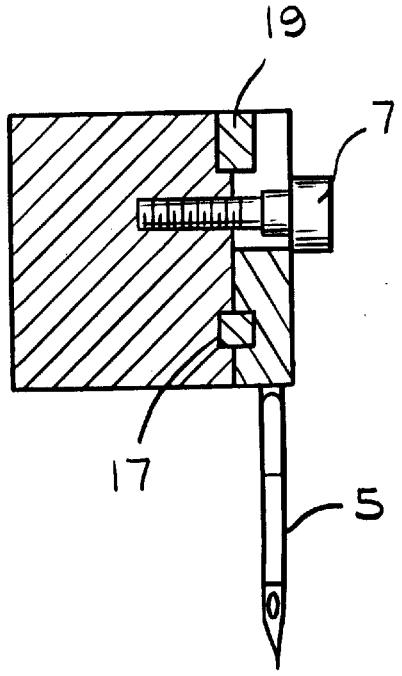
Figure 9:
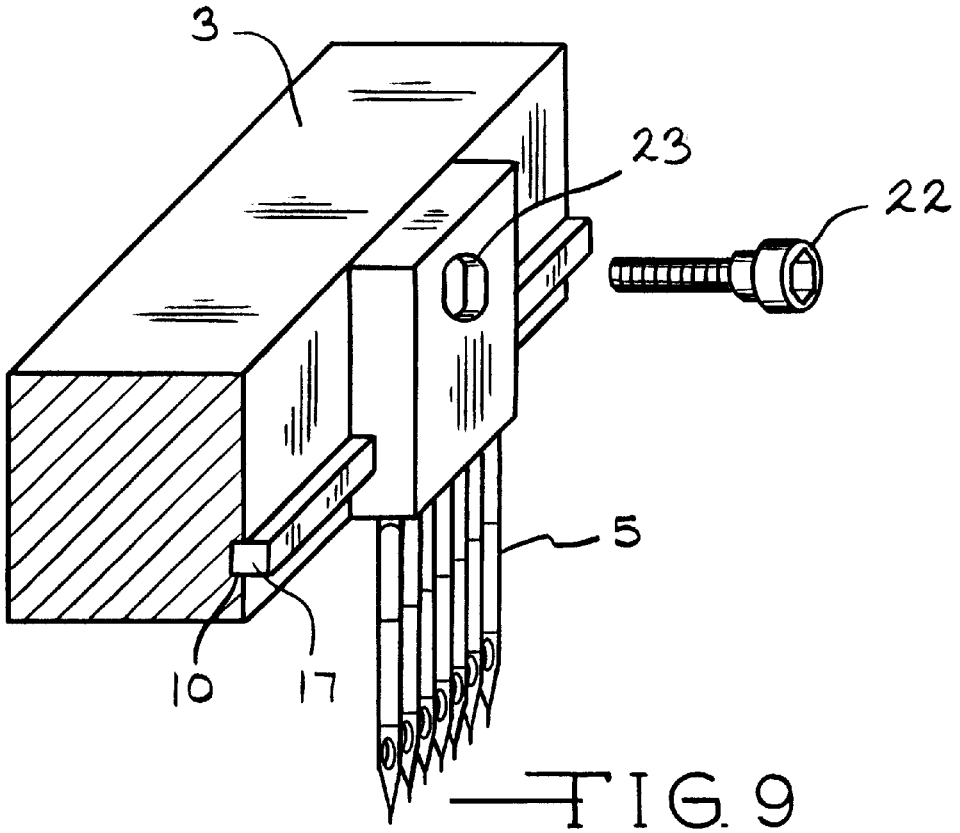
Figure 10:
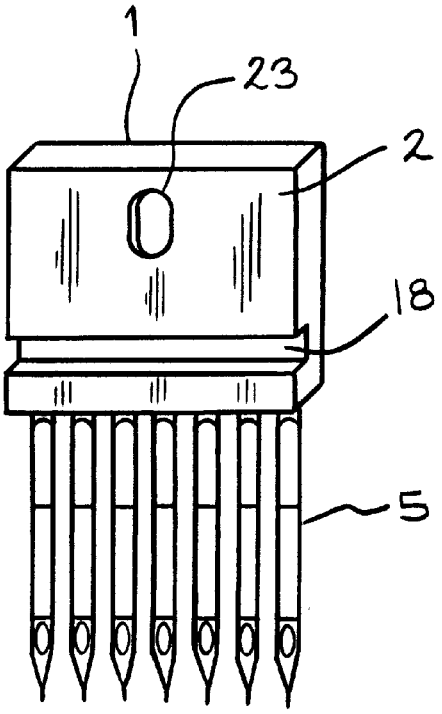
Figure 11:
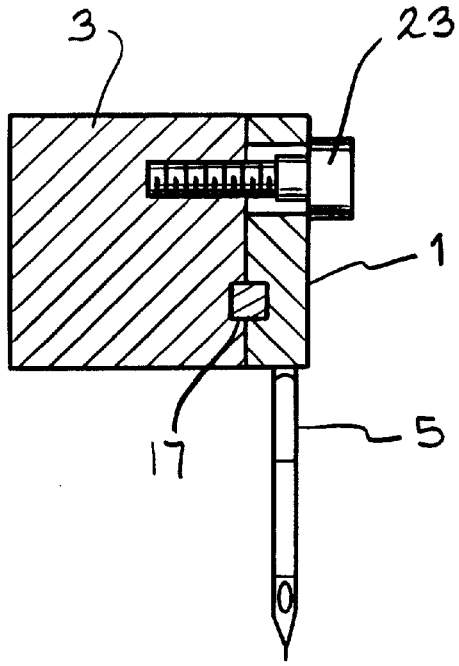

The invention will be explained in more detail below with reference to exemplary embodiments. In the accompanying drawings:

FIG. 1 shows a perspective view of a first embodiment of the invention,

FIG. 2 shows a module corresponding to the embodiment according to FIG. 1 in a perspective top view of the bearing face, FIG. 3 shows a perspective view of a second embodiment of the invention, FIG. 4 shows the locating tongue designed according to the embodiment of FIG. 3, FIG. 5 shows a perspective view of a module corresponding to the embodiment according to FIG. 3, FIG. 6 shows a perspective view of a further embodiment of the invention, FIG. 7 shows a perspective view of a module corresponding to the embodiment according to FIG. 6, and FIG. 8 shows a cross-section through a module according to FIG. 7, FIG. 9 shows a perspective view of a fourth embodiment of the invention, FIG. 10 shows a perspective view of a module corresponding to the according to FIG. 9, and FIG. 11 shows a cross-section through a module according to FIG. 10

The drawings show a module with a basic body 1. The module bears with its plane face 2 on the bearing face 3 of a needle bar 4. The tufting needles 5 are cast with their butts into the basic body 1. The basic body l is provided with a bore 6, through which a screw 7 is led and by means of which the module can be retained on the needle bar 4.

In the exemplary embodiment according to FIGS. 1 and 2, a T-shaped moulded strip, consisting of a horizontal web 8 and of a vertical web 9, is integrally formed on the basic body 1. The horizontal web 8 is received by a longitudinal groove 10 in the needle bar 3. In addition, starting from the longitudinal groove 10, vertically directed grooves 12 are provided along the vertical extent between the longitudinal groove 10 and the lower edge 11 of the needle bar 4. The module engages with the likewise vertically running web 9 of the moulded strip into such a groove 12 and is consequently secured fixedly in terms of displacement and rotation in five directions.

The grooves in the needle bar are cut by milling.

The webs 8 and 9 are worked as a fit for the grooves

The module is fastened to the needle bar 3 by means of the screw 7 and is consequently also secured in the remaining sixth direction. The module cannot be displaced or rotated even under high forces. When modules are exchanged, the position of the exchanged module is assumed again by a new module without any adjustment measure.

FIGS. 3–5 show a second variant of the invention. A special locating tongue 13 is inserted into the longitudinal groove 10 of the needle bar 4 and engages with its parts projecting beyond the bearing face 3 into two horizontal grooves 14 of the module. The two grooves 14 start from the edge of the basic body 1 and leave between them a web 15 which engages into a corresponding recess 16 of the locating tongue 13. The grooves 14 are already formed when the module is produced by the injection-moulding method and do not have to be additionally worked.

FIGS. 6–8 show a further variant of the invention. The needle bar 4 has a continuous longitudinal groove 10. A locating tongue 17 is inserted into the longitudinal groove 10 and projects with its part projecting beyond the bearing face 3 into a longitudinal groove I 8 of the module. The module is consequently secured in both vertical directions. It is secured in the horizontal directions by means of a locating piece 19. The locating piece 19 is inserted into a groove-like recess of the needle bar 4, the said recess commencing directly at the tipper edge of the needle bar 4. The perforation in the module is not designed as a bore, but as an upwardly open U-shaped perforation 21. The length of the locating piece 19 in the axial direction of the needle bar 4 is dimensioned in such a way that the module can be slipped positively with its U-shaped perforation 21 onto that part of the locating piece 19 which projects beyond the bearing face 3 of the needle bar 4.

FIGS. 9–11 show a fourth variant of the invention. As in the variant according to FIGS. 6–8, the needle bar 4 has a continuous longitudinal groove 10, into which a locating tongue 17 is inserted. The module is provided correspondingly with a longitudinal groove 18. The module is secured in the longitudinal direction of the needle bar 4 by means of a locating screw 22. The perforation in the module is designed as a long hole 23, the width of the long hole 23 corresponding to the diameter of fit of the locating screw 22. The module is consequently secured unequivocally in all directions.

The embodiments described have all been illustrated and explained in connection with tufting needles. Instead of needles, the arrangement may also extend to other tools, such as, for example, loopers.

What is claimed is:

1. Module and bar (4) for tufting tools (5), in particular needle module and needle bar, in which the tufting tools (5) are cast at one end into a plate-shaped module basic body (1), the length of which corresponds to a multiple of the center distance of the cast-in tufting tools (5) and which has a plane face (2), bearing on a plane bearing face (3) of the bar (4), and at least one perforation (6), through which a fastening screw (7) can engage and be screwed into the bar (4), characterized in that the module is secured positively to the bar (4) in the vertical direction by means of a first groove-and-tongue joint and in the horizontal direction by means of a second groove-and-tongue joint and is held non-positively in the direction of the bar (4) by means of the fastening screw (7).

2. Module and bar according to claim 1, characterized in that, in order to form the first groove-and-tongue joint, a continuous longitudinal groove (10;18) is provided both in the bar (4) and in the module, and in that a common locating tongue (17) engages into the two longitudinal grooves (10;18).

3. Module and bar according to claim 1, characterized in that, in order to form the first groove-and-tongue joint, a continuous horizontal longitudinal groove (10) is made in the bar (4) and the module has integrally formed on it a horizontal strip (8) which projects perpendicularly to the plane face of the said module and which engages positively into the longitudinal groove (10) of the bar (4).

4. Module and bar according to claim 1, characterized in that, in order to form the first groove-and-tongue joint, a continuous horizontal longitudinal groove (18) is made in the module and the bar (4) has integrally formed on it a horizontal strip which projects perpendicularly to the bearing face (3) of the said bar and which engages positively into the longitudinal groove (18) of the module.

5. Module and bar according to claim 1, characterized in that the module has two longitudinal grooves (14) separated from one another by a transverse web (15), and in that the transverse web (15) engages positively into a corresponding recess (16) of a locating tongue (13) which is inserted positively into a longitudinal groove (10) of the bar (4) and of which the regions located between the recesses (16) engage positively into the longitudinal grooves (14) of the module.

6. Module and bar according to one of claims 2 to 4, characterized in that, in order to form the second groove-and-tongue joint, projecting locating pieces (19) are provided on the bar (4), the said locating pieces engaging positively into a long hole (21) provided in the module.

7. Module and bar according to claim 3, characterized in that, in order to form the second groove-and-tongue joint, starting from the horizontal longitudinal groove (10) in the bar (4), grooves (12) running transversely thereto are provided and the module has integrally formed on it at least one vertical strip (9) which runs perpendicularly to the horizontal strip (8) and which engages positively into such a groove (12) of the bar (4).

8. Module and bar according to claim 4, characterized in that, in order to form the second groove-and-tongue joint, a groove running transversely to the horizontal longitudinal groove (18) in the module is provided and the bar (4) has integrally formed on it a vertical strip which runs perpendicularly to the horizontal strip and which engages positively into the transversely running groove of the module.

9. Module and bar according to claim 4, characterized in that the module has a long hole (23) which runs in the vertical direction and the width of which corresponds to the diameter of a locating screw (22), by means of which the module is fastened to the bar (4).

10. Module and bar according to claim 6 or 9, characterized in that the hole (21; 23) has a larger dimension in the vertical direction than in the horizontal direction.

11. Module and bar according to one of the preceding claims, characterized in that the grooves (10; 12; 14; 18) are cut by milling.

12. Module and bar according to one of claims 3 or 7, characterized in that the module has integrally formed strips (8; 9) which project perpendicularly to the bearing face (2).

13. Module and bar according to one of claims 3, 7 or 12, characterized in that the strips (8; 9) are formed to fit in the grooves 10 and 12.

14. Module and bar according to one of claims 3, 7, 12 or 13, characterized in that the strips (8; 9) are integrally formed on the module by an injection-moulding method.

* * * * *